US010283840B2

(12) United States Patent
Karlsson

(10) Patent No.: US 10,283,840 B2
(45) Date of Patent: May 7, 2019

(54) MULTI-BAND WLAN ANTENNA DEVICE

(71) Applicant: InCoax Networks AB, Gävle (SE)

(72) Inventor: Carl Karlsson, Sandviken (SE)

(73) Assignee: INCOAX NETWORKS AB, Gävle (SE)

( * ) Notice: Subject to any disclaimer, the term of this patent is extended or adjusted under 35 U.S.C. 154(b) by 55 days.

(21) Appl. No.: 15/341,500

(22) Filed: Nov. 2, 2016

(65) Prior Publication Data

US 2017/0324146 A1 Nov. 9, 2017

(30) Foreign Application Priority Data

Apr. 18, 2016 (SE) ..... 1630092

(51) Int. Cl.

| | |
|---|---|
| ***H01Q 1/22*** | (2006.01) |
| ***H01Q 1/36*** | (2006.01) |
| ***H01Q 1/38*** | (2006.01) |
| ***H01Q 1/48*** | (2006.01) |
| ***H01Q 1/52*** | (2006.01) |

(Continued)

(52) U.S. Cl.

CPC ..... *H01Q 1/2291* (2013.01); *H01Q 1/36* (2013.01); *H01Q 1/38* (2013.01); *H01Q 1/48* (2013.01); *H01Q 5/371* (2015.01); *H01Q 5/50* (2015.01); *H01Q 9/42* (2013.01); *H01Q 21/24* (2013.01); *H01Q 21/28* (2013.01); *H01Q 1/521* (2013.01); *H01Q 5/35* (2015.01)

(58) Field of Classification Search

CPC ..... H01Q 1/2291; H01Q 1/48; H01Q 1/38; H01Q 1/521; H01Q 1/52

See application file for complete search history.

(56) References Cited

U.S. PATENT DOCUMENTS

2006/0181464 A1* 8/2006 Erkocevic ..... H01Q 1/243 343/702
2011/0134897 A1* 6/2011 Montemurro ..... H04M 1/72536 370/338

(Continued)

FOREIGN PATENT DOCUMENTS

| | | | |
|---|---|---|---|
| DE | 202014103657 | U1 | 7/2015 |
| EP | 1083624 | B1 | 2/2006 |
| EP | 2790268 | A1 | 10/2014 |

OTHER PUBLICATIONS

International-Type Search Report for Swedish Patent Application No. SE 1630092-3 dated Nov. 2, 2016.

(Continued)

*Primary Examiner* — Ricardo I Magallanes

(74) *Attorney, Agent, or Firm* — Moore & Van Allen PLLC; Henry B. Ward, III

(57) ABSTRACT

A multi-band WLAN antenna device, comprising a layer of conductive material forming a planar ground plane, having a first side edge in which a first cutout is formed, having an indented cutout edge and first and second connecting edges. A first antenna structure is formed in the cutout, comprising a first member projecting from the first connecting edge and extending parallel to the indented cutout edge. The antenna structure also includes a second member having a first part projecting from a feed point at the indented cutout edge, extending through the first member, and a second part connected to the first part and extending parallel to the first member away from the first connecting edge.

19 Claims, 3 Drawing Sheets

(51) Int. Cl.

| | |
|---|---|
| ***H01Q 5/35*** | (2015.01) |
| ***H01Q 5/50*** | (2015.01) |
| ***H01Q 9/42*** | (2006.01) |
| ***H01Q 21/24*** | (2006.01) |
| ***H01Q 21/28*** | (2006.01) |
| ***H01Q 5/371*** | (2015.01) |

(56) References Cited

U.S. PATENT DOCUMENTS

| | | | | |
|---|---|---|---|---|
| 2014/0203993 | A1* | 7/2014 | Toyao | H01Q 13/10 343/867 |
| 2015/0372383 | A1* | 12/2015 | Yoshida | H01Q 1/2291 343/853 |
| 2016/0294062 | A1* | 10/2016 | Lo Hine Tong | H01Q 1/2291 |

OTHER PUBLICATIONS

Office Action issued by the Swedish Patent and Registration Office for Swedish Patent Application No. SE 1630092-3 dated Nov. 2, 2016.

International Search Report and Written Opinion for corresponding PCT Patent Application No. PCT/SE2017/050268 dated May 15, 2017.

* cited by examiner

MULTI-BAND WLAN ANTENNA DEVICE

FIELD OF THE INVENTION

The present invention relates to the architecture of a wideband, high gain and high efficiency multi-band antenna for WLAN (Wireless Local Area Network) communications. More specifically it relates to a low profile antenna configured for use in at least two bands, suitable for operation in a router or modem.

BACKGROUND

Current wireless communication devices such as notebook computer, tablet computer, mobile phones etc. have an increasing demand for wide bandwidth wireless network access. This may be obtained by wireless connection to a router, modem or access point, which in turn is connected to a core network. Wireless communication protocols are oftentimes standardized so that competing manufacturers can produce products that will interoperate. Standards are set by the Institute of Electrical and Electronics Engineers (IEEE), following a numeric designation of 802.11, followed by a letter signifying the exact flavor of the protocol, e.g. 802.11g and 802.11n.

Traditionally, WLAN access points have been provided with elongate antennas configured for both transmission and reception. However, for convenient assembly and installation purposes, low profile antenna devices are desirable, but at the same time this poses a challenge to antenna performance.

SUMMARY

A primary objective is to provide a WLAN antenna operational in at least two different frequency bands. Another objective is to provide a low profile antenna that is compact in size especially small in one dimension so it can be easily fabricated and embedded into compact stationary or mobile device.

According to one aspect, these objectives are targeted by means of a multi-band WLAN antenna device comprising a layer of conductive material forming a planar ground plane, having a first side edge, wherein a first cutout is formed in said first side edge, having an indented cutout edge and first and second connecting edges extending between the indented cutout edge and the first side edge, a first antenna structure formed in the cutout comprising a first member projecting from the first connecting edge and extending parallel to the indented cutout edge; and a second member having a first part projecting from a feed point at the indented cutout edge, extending through the first member, and a second part connected to the first part and extending parallel to the first member away from the first connecting edge.

According to another aspect, a modem is provided, comprising a data signal connector for providing wired access to a data network, a WLAN circuit connected to the connector for establishing a radio access connection, and a circuit board comprising multi-band WLAN antenna device as described for the first aspect.

These and other aspects are evident from the claims.

BRIEF DESCRIPTION OF THE DRAWINGS

Embodiments are described below with reference to the accompanying drawings, in which.

DETAILED DESCRIPTION

Figure 1:
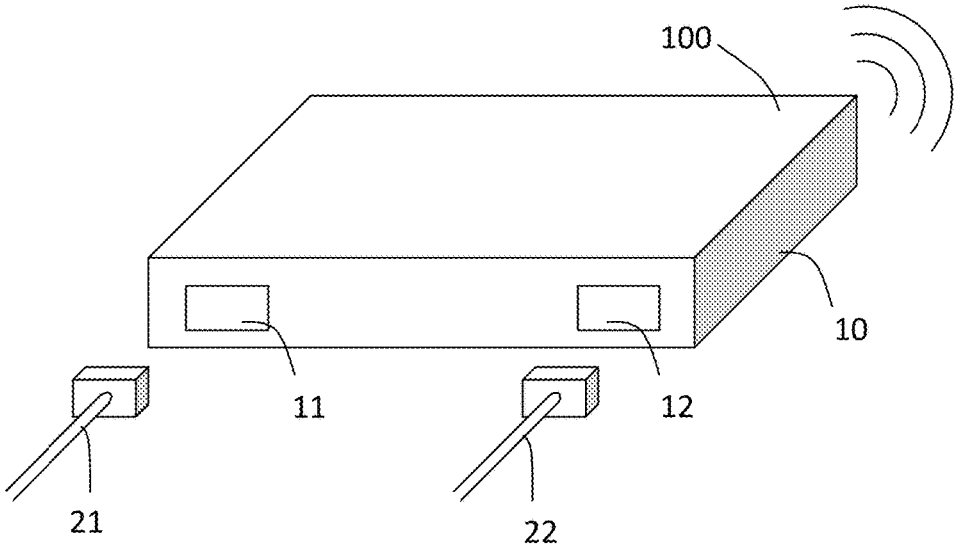
FIG. 1 is a view of a communications modem comprising an antenna device for wireless communication.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout. It will furthermore be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Well-known functions or constructions may not be described in detail for brevity and/or clarity. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

The invention relates to a multi-band WLAN antenna device. As such, the antenna device may be embodied as part of a radio communications terminal, such as a phone, a tablet, a laptop or stationary computer, or similar. In other embodiments, the antenna device may be incorporated in a device for providing wireless access to a communications or data supply network. This may include incorporation of the antenna device in a modem, in a router or access point, or similar, for providing a WLAN access network.

FIG. 1 illustrates, quite schematically, a data access modem 10. The modem includes a port 11, connectable to connector cable or plug 21 for providing data network access. The cable 21 may directly provide access to a data network, or to an intermediate supply network, which in turn is connected to a data network. In one embodiment, port 11 may be connected to a coax outlet originally configured for television signal access in an apartment or hotel room of a building, by means of cable or plug 21. The modem 10 also includes an output port 12, which e.g. may be connected to provide a TV signal to a TV set or setup box, by means of a cable or plug 22. Alternatively, or in addition, port 12 may comprise one or several RJ45 ethernet ports where a computer, IP-telephony box, an IPTV box etc. may be connected. In addition to physical output port 12, the modem 10 includes WLAN circuitry and antennas of a WLAN antenna device 100. The modem 10 further comprises circuitry (not shown) for handling data communication between the ports, and the WLAN antenna device, the function of which will not be dealt with further herein.

Figure 2:
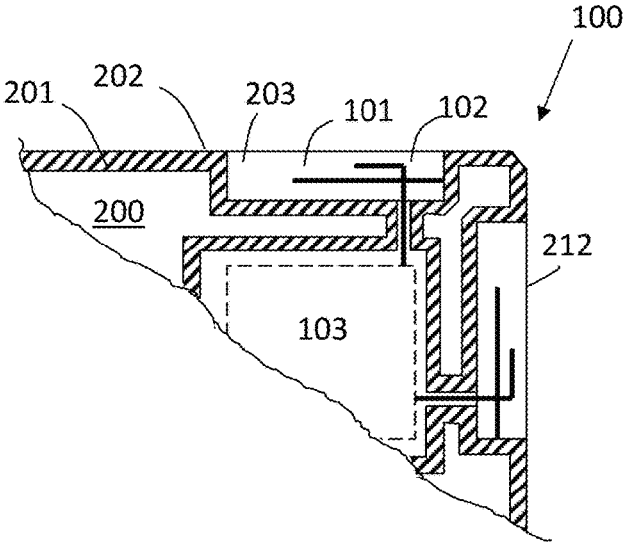
FIG. 2 is a view of a part of an antenna device configured as a pattern on a printed circuit board (PCB)

FIG. 2 shows a part of a PCB 200, carrying an antenna device 100 according to one embodiment, which may be incorporated in the modem of FIG. 1. In this embodiment, it may be seen that the antenna device 100 is formed as combination of a layer 201 of conductive material forming a planar ground plane, e.g. a copper layer, and an antenna pattern obtained by etching out conductive material from the ground plane 201 to obtain a cutout portion 203 with remaining traces forming antenna members 101 and 102. In this embodiment, the antenna device has the beneficial configuration that it is provided at a first side edge 202 adjacent to a corner position of the PCB 200. This way it may be conveniently located away from disturbing circuits, and may be easily shielded off. In addition, as is evident from the drawing, the antenna device 100 may in various embodiments include a second cutout formed in a second side edge 212, perpendicular to the first side edge, in which a second antenna structure is formed, corresponding to but perpendicular to the first antenna structure. A WLAN circuit 103 is schematically illustrated in the drawing, which includes a signal transceiver connected as a feed point to the antenna elements.

Figure 3:
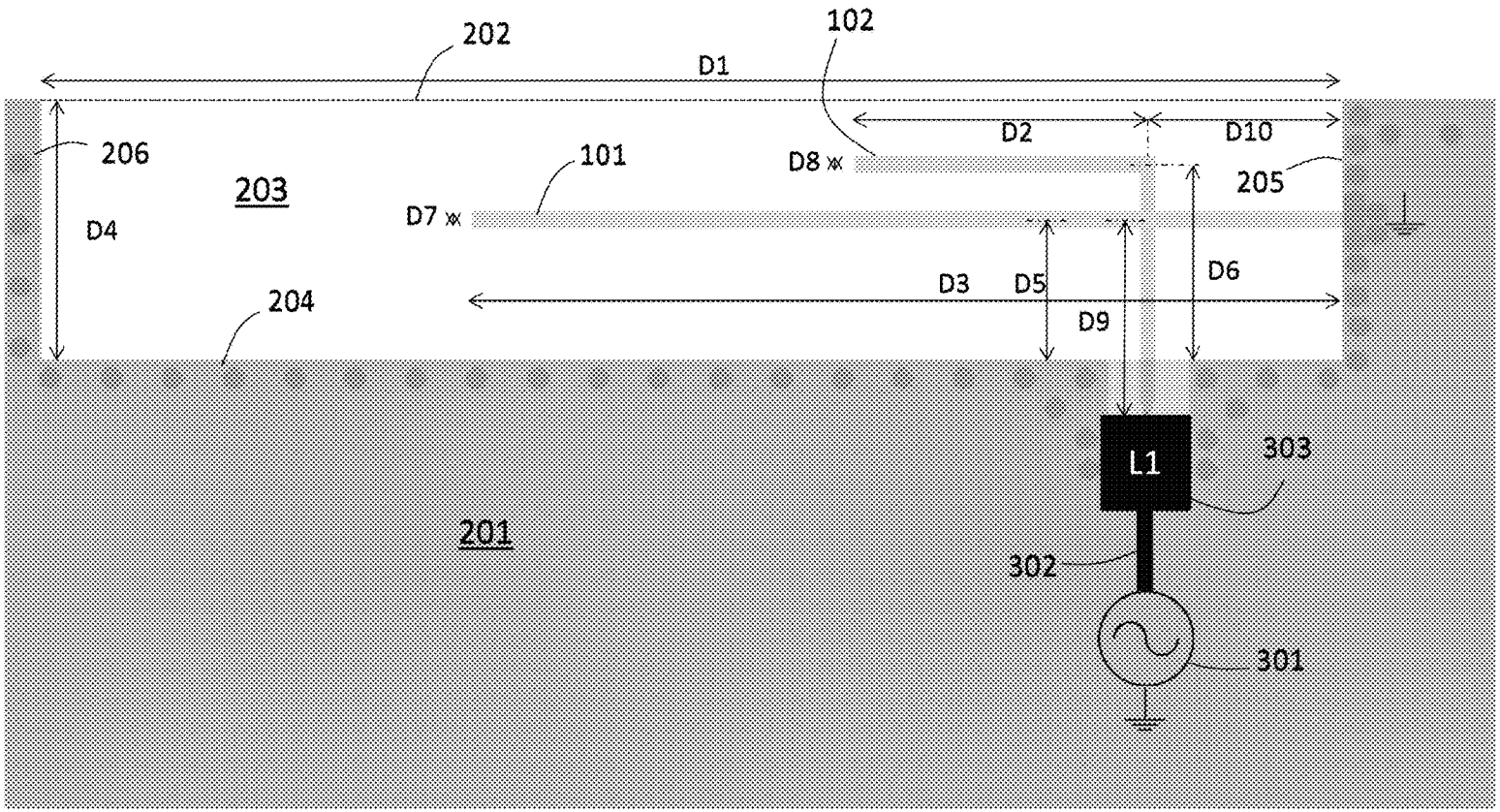
FIG. 3 shows an enlarged view of an antenna pattern for one embodiment.

FIG. 3 schematically illustrates a more detailed view of one embodiment of an antenna device 100 according to the invention. The antenna device may be provided on a single or multi-layer PCB 200, where multi-layer PCBs may include VIAs at edges, as indicated by dots in the drawing. The ground plane 201 has a first side edge 202, in which a first cutout 203 is formed, in the sense that the cutout lacks a coherent conductive layer. This may conveniently be obtained by etching of the ground plane 201, but alternatively by selectively providing conductive material only to various parts of the PCB 200. The first cutout 203 has an indented cutout edge 204, which preferably is parallel or substantially parallel to the first side edge 202. First 205 and second 206 connecting edges extend between the indented cutout edge 204 and the first side edge 201.

In the cutout, a first antenna structure 100 having a beneficial pattern is formed. The antenna structure comprises a first member 101, which projects from the first connecting edge 205 and extends parallel to the indented cutout edge 204. This longer member provides main contribution to suitable resonance at a lower bandwidth frequency, preferably at 2.4 GHz. In addition, the antenna structure comprises a second member 102 having a first part projecting from an antenna feed point 301 at the indented cutout edge, extending through the first member 101, and a second part connected to the first part and extending parallel to the first member 101 away from the first connecting edge 205. This configuration of the second member 102 provides main contribution to resonance at a second, higher frequency, preferably at 5.2 GHz.

This configuration provides a low profile antenna, which can be embodied in a very shallow cutout, while still providing excellent radio characteristics. This way, a highly efficient multi-band antenna for use in WLAN is obtained, which at the same time is very compact and has a small footprint.

The second member 102 is preferably connected to a 50 Ohm signal transceiver 301 acting as a feed point of the WLAN circuit, through a trench in the ground plane 201 formed at indented cutout edge 204. In a preferred embodiment, an inductive element L1 303, e.g. a coil, connects the feed point 301 to second member. The inductive element is suitably arranged at a distance (D9) of between 1 and 4 mm, e.g. 3.0 mm, from the center point of the junction between the first and second antenna members 101, 102. Feed point extension or retraction into PCB can be compensated for by suitably selecting a tuning inductor L1, e.g. batch-wise, so as to fine tune the antenna resonance at low cost. The tuning inductor may e.g. be selected or tuned to have an inductance of 2.7±1 nH, which is connected to the signal transceiver by means of a 50 Ohm PCB trace.

In the preferred embodiment, the cutout 203 is substantially rectangular, the indented cutout edge 204 (D1) being 29.9±0.2 mm long, whereas the depth of the cutout 203 (D4) may be in the range of 6.0±0.2 mm.

The first member 101 (D3) preferably extends 20.0±0.1 mm and has an impedance of 50 Ohm as defined by its width. Typically, the width (D7) may be in the range of 0.34 mm±10%.

In the embodiment of FIG. 3 the first member (D5) may extend parallel to the indented cutout edge 204 at a center distance of about 1.8 mm. The first part (D6) of the second member extends substantially perpendicular to the first member, for a distance of 3.0 mm from the indented cutout edge 204, in the illustrated preferred embodiment. This first part of the second member 102 preferably extends parallel to and at a center distance (D10) of 4.2±0.5 mm from the first connecting edge 205. The first part runs through the first member, in conductive connection, creating a junction of the first and second members 101, 102 like a crossroads. This design has proven to give excellent results, despite the compact antenna structure.

The second part of the second member 102 adjoins the outer end of the first part of the second member 102, as can be seen in the drawings, and extends perpendicular thereto. This means that there is a center distance between the first member 101 and the second part of the second member 102, which extend in parallel, of about 1.2 mm. In one embodiment, the distances D5 and D6 may vary between +2.0/−0.1 mm from the indicated values, with simultaneous adjustment. The second part of the second member 102 preferably extends (D2) for 6.9±0.1 mm parallel to the first member, and also has an impedance adjusted to 50 Ohm by configuration of the trace width (D8).

Figure 4:
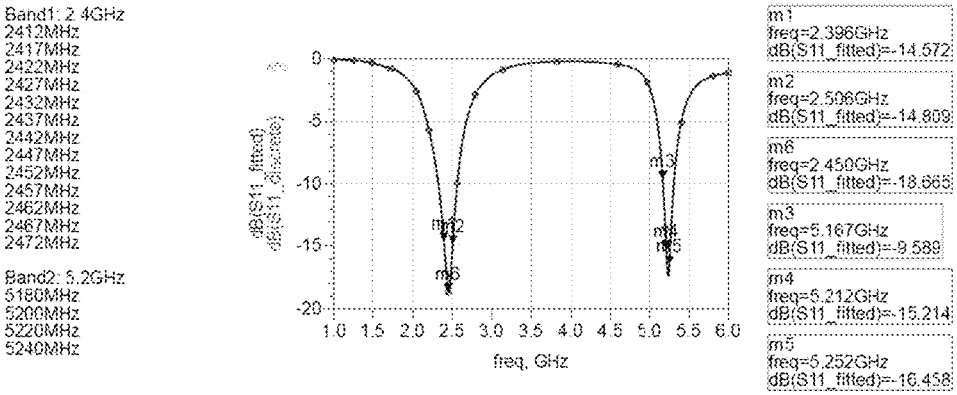
FIG. 4 shows a graph of antenna excitation as a function of frequency for the exemplary antenna system according to FIG. 3.

FIG. 4 illustrates a graph of the VSWR (Voltage Standing Wave Ratio) as a function of frequency for an exemplary antenna device as embodied in FIG. 3. The exemplary antenna device 100 has been tuned, by means of employing dimensions in the described ranges, to resonate around both a frequency of 2.4 GHz and at 5.2 GHz. The graph indicates the magnitude in dB, according to the established art, and clearly indicates that over 17 dB is obtained in both bands with the described new antenna device design.

The described embodiments illustrate a dual band antenna device. However, it should be understood that more band may be covered, e.g. by addition of more antenna members, without surrendering the described principles and design.

The invention claimed is:

1. A multi-band WLAN antenna device, comprising:

a layer of conductive material forming a planar ground plane, said ground plane having a first side edge wherein a first cutout is formed in said first side edge, said first cutout having a first indented cutout edge wherein first and second connecting edges extend between the first indented cutout edge and the first side edge;

a first antenna structure formed in the first cutout, said first antenna structure comprising:

a first member projecting from the first connecting edge and extending parallel to the first indented cutout edge;

a second member having a first part projecting from a feed point at the first indented cutout edge, wherein said first part extends through the first member, and a second part connected to said first part and extending parallel to the first member away from the first connecting edge; and a second antenna structure formed in a second cutout, wherein said second cutout is formed in a second side edge of the ground plane perpendicular to the first side edge, said second cutout having a second indented cutout edge wherein third and fourth connecting edges extend between the second indented cutout edge and the second side edge and wherein said second antenna structure is perpendicular to the first antenna structure and comprises:

a third member projecting from third connecting edge and extending parallel to the second indented cutout edge;

a fourth member having a first part projecting from a feed point at the second indented cutout edge, wherein said first part extends through the third member, and a second part connected to said first part and extending parallel to the third member away from the third connecting edge.

2. The multi-band WLAN antenna device of claim 1, wherein the first indented cutout edge is substantially parallel to the first side edge.

3. The multi-band WLAN antenna device of claim 1, wherein the second member is connected to the feed point through a trench in the ground plane formed at the first indented cutout edge.

4. The multi-band WLAN antenna device of claim 1, wherein an inductor connects the feed point to the second member.

5. The multi-band WLAN antenna device of claim 1, wherein said first cutout is rectangular in shape, and the first indented cutout edge is 29.9±0.2 mm long.

6. The multi-band WLAN antenna device of claim 1, wherein the first member extends 20.0±0.1 mm and has an impedance of 50 Ohm.

7. The multi-band WLAN antenna device of claim 1, wherein the first member extends at a center distance of 1.8+2.0/−0.1 mm from the first indented cutout edge.

8. The multi-band WLAN antenna device of claim 1, wherein the first part of the second member extends 3.0+2.0/−0.1 mm from the first indented cutout edge.

9. The multi-band WLAN antenna device of claim 1, wherein the first part of the second member extends at a center distance of 4.2±0.5 mm from the first connecting edge.

10. The multi-band WLAN antenna device of claim 1, wherein the second part of the second member extends 6.9±0.1 mm parallel to the first member and has an impedance of 50 Ohm.

11. The multi-band WLAN antenna device of claim 1, wherein the first member and the second part of the second member extend at a center distance of 1.2±0.1 mm from each other.

12. The multi-band WLAN antenna device of claim 1, wherein the first and second connecting side edges have a length of 6.0±0.2 mm, defining a depth of the first cutout.

13. The multi-band WLAN antenna device of claim 1, providing dual band resonance at about 2.4 GHz and 5.2 GHz.

14. The multi-band WLAN antenna device of claim 1, further comprising:

a modem including:

a data signal connector for providing wired access to a data network;

a WLAN circuit connected to the connector for establishing a radio access connection; and a circuit board comprising the multi-band WLAN antenna device.

15. The multi-band WLAN antenna device of claim 2, wherein the first part of the second member extends 3.0+2.0/−0.1 mm from the first indented cutout edge.

16. The multi-band WLAN antenna device of claim 3, wherein the first part of the second member extends 3.0+2.0/−0.1 mm from the first indented cutout edge.

17. The multi-band WLAN antenna device of claim 4, wherein the first part of the second member extends 3.0+2.0/−0.1 mm from the first indented cutout edge.

18. The multi-band WLAN antenna device of claim 5, wherein the first part of the second member extends 3.0+2.0/−0.1 mm from the first indented cutout edge.

19. The multi-band WLAN antenna device of claim 6, wherein the first part of the second member extends 3.0+2.0/−0.1 mm from the first indented cutout edge.

* * * * *